United States Patent [19]

Horinchi

[11] Patent Number: 4,811,878

[45] Date of Patent: Mar. 14, 1989

[54] UNIVERSAL TOWEL DISPENSER

[75] Inventor: Yutaka Horinchi, Kitchener, Canada

[73] Assignee: Twin-Cee Limited, Georgetown, Canada

[21] Appl. No.: 9,453

[22] Filed: Feb. 2, 1987

[51] Int. Cl.[4] ..... B65H 35/04

[52] U.S. Cl. ..... 225/46; 225/53; 221/44; 221/46; 312/37

[58] Field of Search ..... 225/32, 39, 46, 53, 225/106, 77; 312/37; 221/44, 45, 46, 48, 53, 54, 55

[56] References Cited

U.S. PATENT DOCUMENTS

| | | | |
|---|---|---|---|
| Re. 21,678 | 12/1940 | Daykin | 225/53 X |
| 3,028,047 | 4/1962 | Tuft | 221/46 X |
| 3,173,590 | 3/1965 | Bahnsen | 225/46 X |
| 3,597,032 | 8/1971 | Harangozo | 312/37 |
| 3,713,561 | 1/1973 | Wyant | 221/44 |

*Primary Examiner*—Frank T. Yost
*Assistant Examiner*—Michael D. Folkerts

[57] ABSTRACT

The present invention provides a towel cradle particularly useful with any one of standard C-fold, multi-fold, single fold and rolled paper towel to be dispensed from a paper towel dispenser. The towel cradle comprises a hopper-like cradle body having an apertured towel support surface provided with a dispensing opening and a substantially solid towel support surface each of which is set at a downward inward angle continuing to a centrally positioned throat formed by downward extensions on each of the surfaces. The downward extension on the solid support surface is additionally provided with a paper cutting edge integral to said towel cradle. The cradle body is reversible within the towel dispenser such that in a first dispensing position the apertured support surface is positioned forwardly in the dispenser which is fitted with a towel guide for dispensing C-fold and multi-fold towels through the dispensing opening with the paper cutting edge being generally hidden to the rear of the dispenser. When reversed to a second dispensing position the solid support surface is positioned forwardly in the dispenser for dispensing single fold and rolled paper through the throat of the cradle with the opening in the apertured support surface now being hidden to the rear of the dispenser.

2 Claims, 6 Drawing Sheets

FIG.1A.
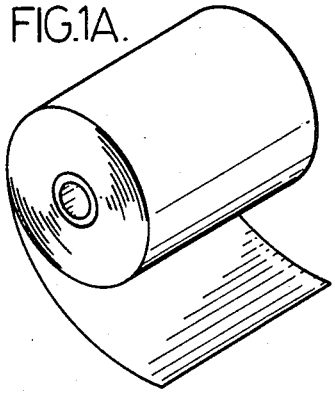
FIG.1C.
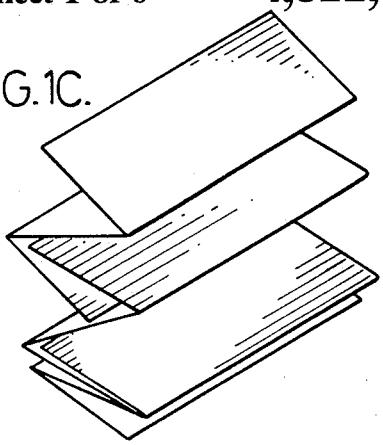
FIG.1B.
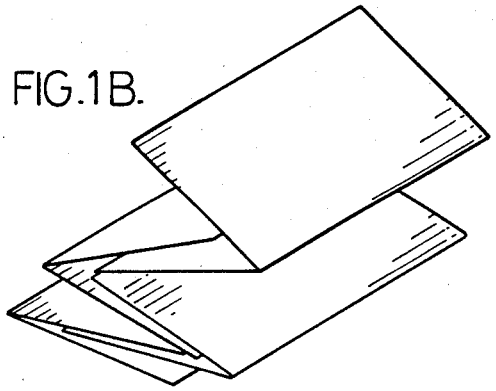
FIG.1D.
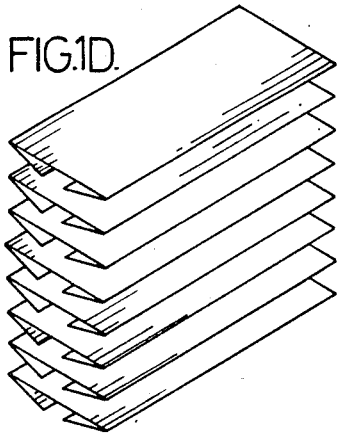
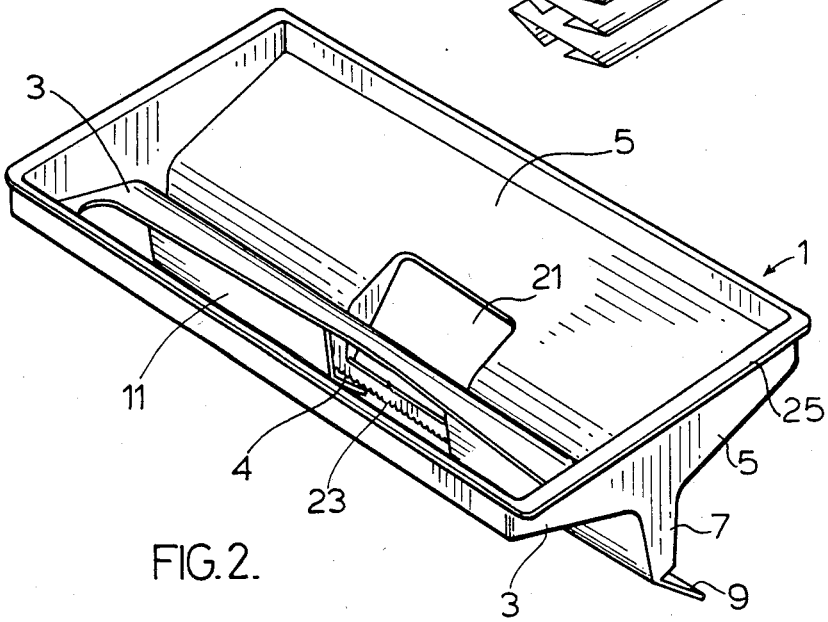
FIG.2.

UNIVERSAL TOWEL DISPENSER

FIELD OF THE INVENTION

The present invention relates to a towel cradle and in particular a towel cradle assembly adapted so that it is usable with any one of four different types of paper towels namely, C-fold, multi-fold, single fold and rolled paper towel to be dispensed from a paper towel dispenser.

BACKGROUND OF THE INVENTION

In the paper industry and in particular in the paper towel industry there is a need for a dispenser which is readily adapable for dispensing different types of paper products and in particular paper towel products in the form of single-fold, multi-fold, C-fold and rolled paper towel.

U.S. Pat. No. 3,597,032 issued Aug. 3, 1971 to Watrous International Industries Limited, describes a towel dispenser designed for use with the different types of paper towels referred to above. This patented structure uses a reversible cradle which is good in principle but which is extremely complicated and difficult to work with from a practical standpoint. In particular, the patented structure includes a series of separate components including removable towel cutting bars and the like with no storage capacity for those components. In addition, the structure requires a series of nuts and bolts for mounting the cradle within a dispenser which make it difficult and awkward to quickly and easily reverse the positioning of the cradle as required in the patent.

SUMMARY OF THE PRESENT INVENTION

The present invention provides a cradle for use in a dispenser and particularly useful in a paper product dispenser. The cradle comprises a cradle body having first and second support surfaces set up in a hopper-like manner with each support surface being sloped downwardly inwardly to a centrally positioned throat formed by downward extensions of the support surfaces. The downward extension on the second support surface is provided with a cutting edge integral to the cradle. The first surface includes a dispensing opening and the second support surface is substantially solid with the exception of a finger grip access at the throat. The cradle body is reversible within the dispenser without having to remove any nuts or bolts and the like from a first dispensing position in which the first support surface is located to the front of the cradle for dispensing through the opening with the cutting edge being generally hidden behind the front support surface to a second dispensing position in which the second support surface is located to the front of the cradle for dispensing through the throat with the opening then being hidden to the back of the cradle body.

According to an aspect of the present invention, a towel guide is used for dispensing C-fold and multi-fold towels through the dispensing opening when the cradle is in its first dispensing position. When the cradle body is reversed to its second dispensing position for use in dispensing single-fold and rolled paper towel through the throat, the towel guide is not required and is fitted to the first support surface where it is self-storing within the cradle and readily available when the cradle is reversed back to the first dispensing position.

BRIEF DISCUSSION OF THE DRAWINGS

The above as well as other advantages and features of the present invention will be described in greater detail according to the preferred embodiments of the present invention in which;

FIGS. 1*a* through 1*d* show rolled, single-fold, multi-fold, and C-fold paper towels which do not form part of the present invention;

FIG. 2 is a top perspective view of a towel cradle body according to a preferred embodiment of the present invention.

DETAILED DESCRIPTION ACCORDING TO THE PREFERRED EMBODIMENTS OF THE PRESENT INVENTION

Figure 3:
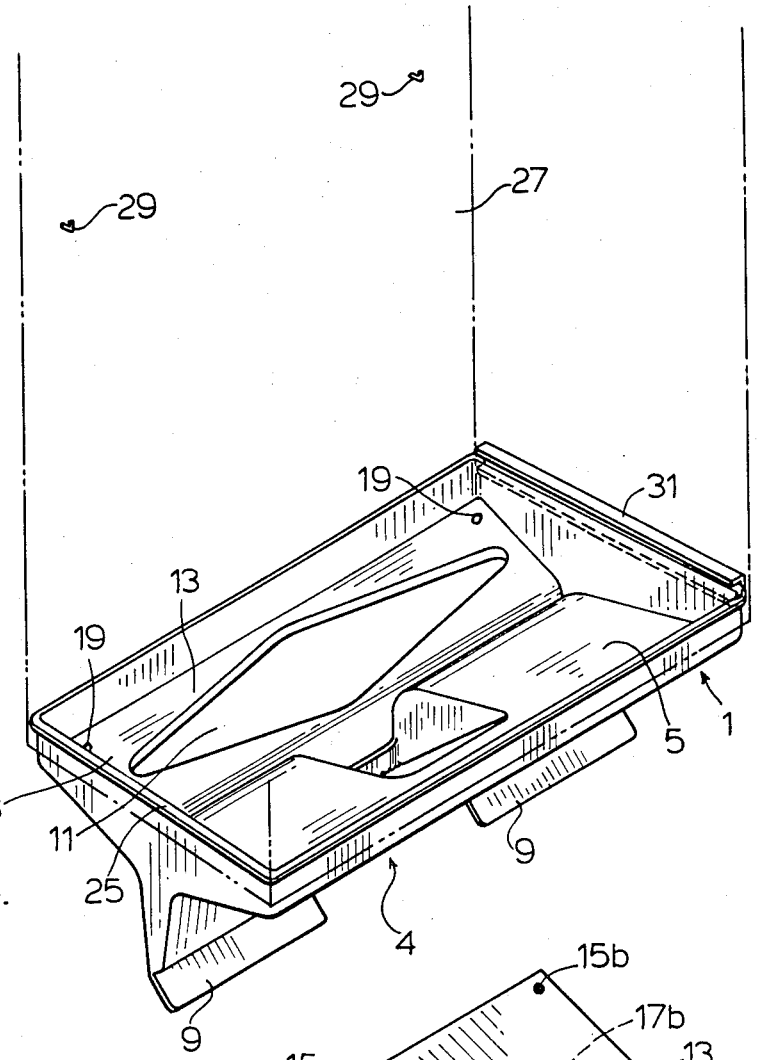
FIG. 3 is a further top perspective view from the opposite side of the towel cradle body from that shown in FIG. 2.

As mentioned above, FIGS. 1*a* through 1*d* show the different types of paper towels to be dispensed from a towel dispenser 27 seen in FIG. 3 and fitted with a hopper cradle body generally indicated at 1. This cradle body, which is shown outside of the dispenser in FIG. 2, comprises a first apertured surface 3 and a second substantially solid surface 5 which angle downwardly inwardly at one another to provide the hopper-like construction of the cradle body. These surfaces extend downwardly as seen for example in FIG. 5 to provide a throat 7 located centrally along the cradle body.

The apertured and solid surfaces 3 and 5 respectively may be set at an angle of anywhere from 20° to 25° and preferably at about 23° from horizontal. It has been found that this angling results in enhanced feed characteristics of the paper towel as to be described later in detail.

The apertured surface 3 of the towel cradle is provided with an elongated elliptical opening 11 occupying much of that surface. In contrast, support surface 5 is substantially solid with the exception of a finger grip access 21. Provided along the extreme lower edge of support surface 5 is a serrated paper cutting bar 23.

The extreme lower edge of the apertured surface of the cradle 3 terminates in a pair of deflectors 9 separated from one another centrally of the cradle by a further grip access 4 aligned with access region 21.

In accordance with the present invention, cradle body 1 is designed for reversible use within towel dispenser housing 27. Here it should be noted that in FIGS. 5, 6 and 7 the cradle body is positioned such that apertured surface 3 is positioned to the front of the dispenser, whereas in FIGS. 3, 9 and 10 the cradle body is reversed with solid surface 5 being positioned to the front and apertured surface 3 being positioned to the back of the dispenser. In the first position, the cradle is used for the dispensing of multi-fold and C-fold towels, which are shown in FIGS. 1*c* and 1*d*, and when the cradle is reversed with surface 5 at the front of the dispenser it is used for the dispensing of rolled and single-fold towels which are shown in FIGS. 1*a* and 1*b*.

Figure 4:
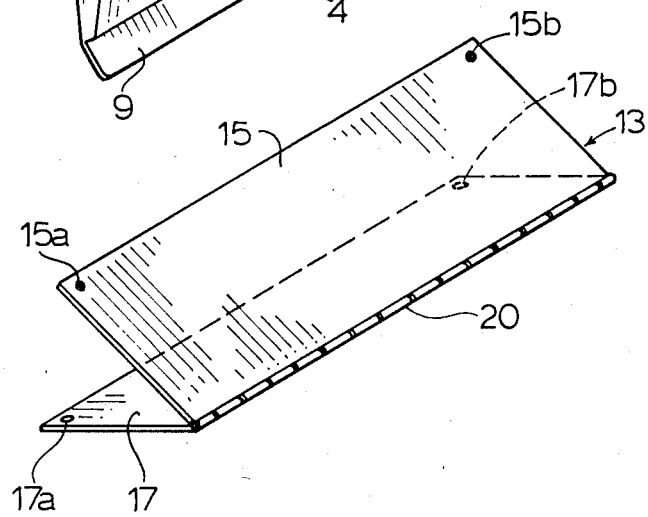
FIG. 4 is a top perspective view showing the folding of the towel guide to be fitted to the rear of the cradle body of FIG. 3.
Figure 5:
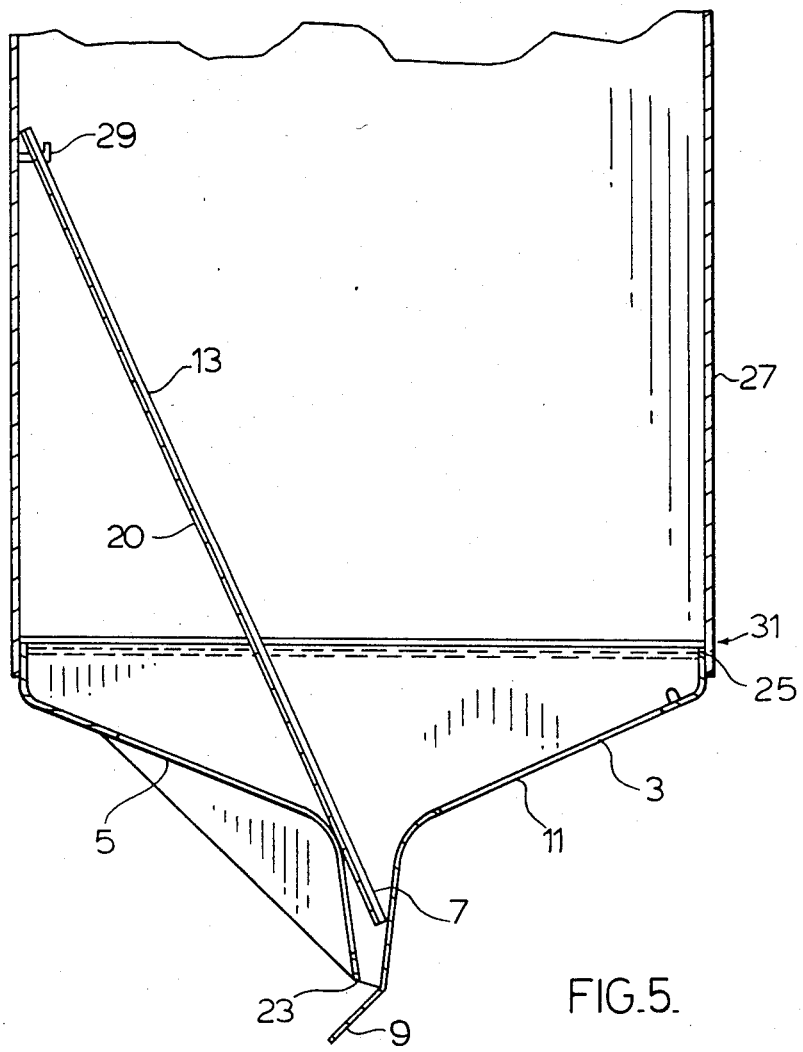
FIG. 5 is a sectional view of the towel cradle in its dispensing position for the dispensing of C-fold and multi-fold towels.
Figure 6:
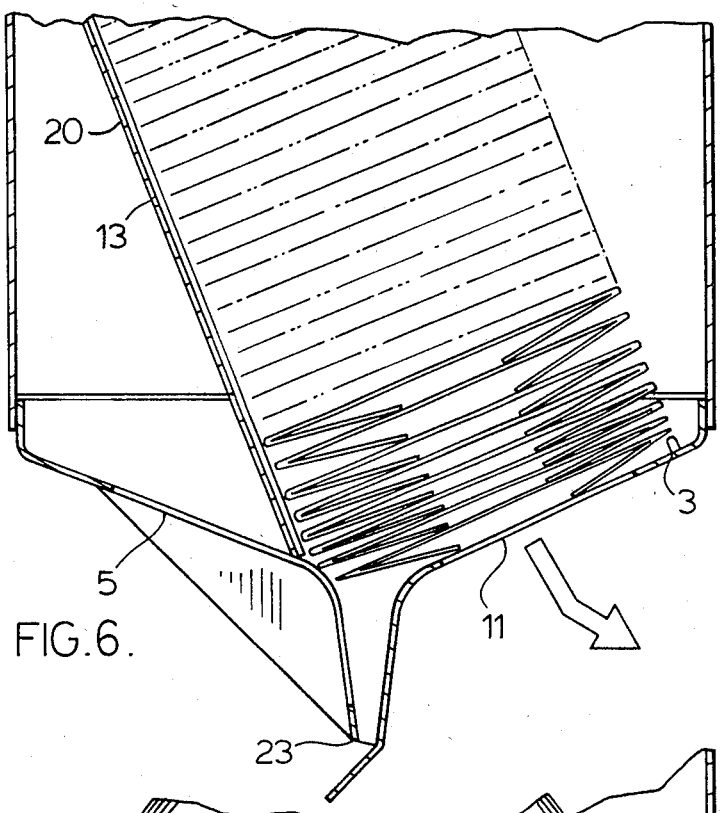
FIGS. 6 and 7 are views similar to that of FIG. 5 and actually showing the dispensing of C-fold and multi-fold towels respectively.
Figure 8:
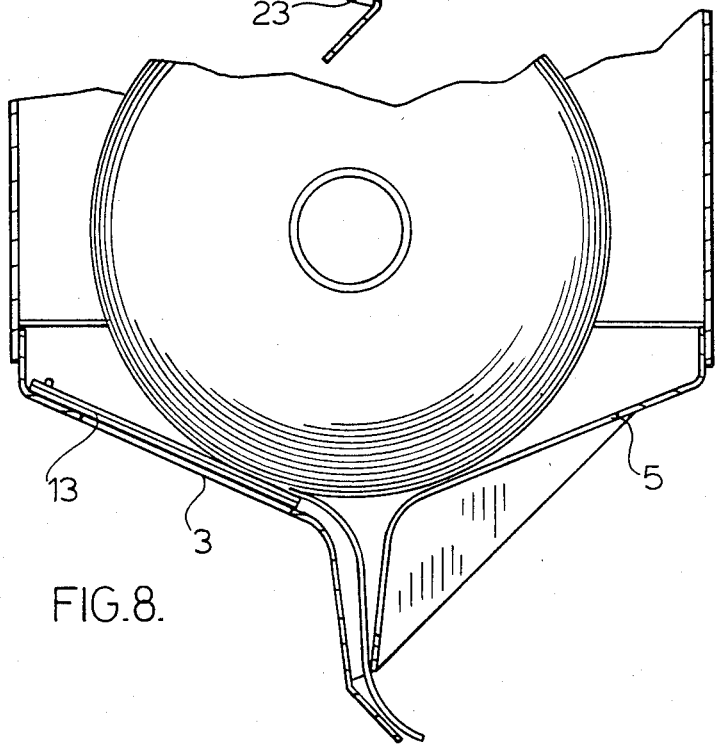
FIG. 8 shows the towel cradle reversed from the FIGS. 5 through 7 positions with the dispensing of rolled paper towel.
Figure 7:
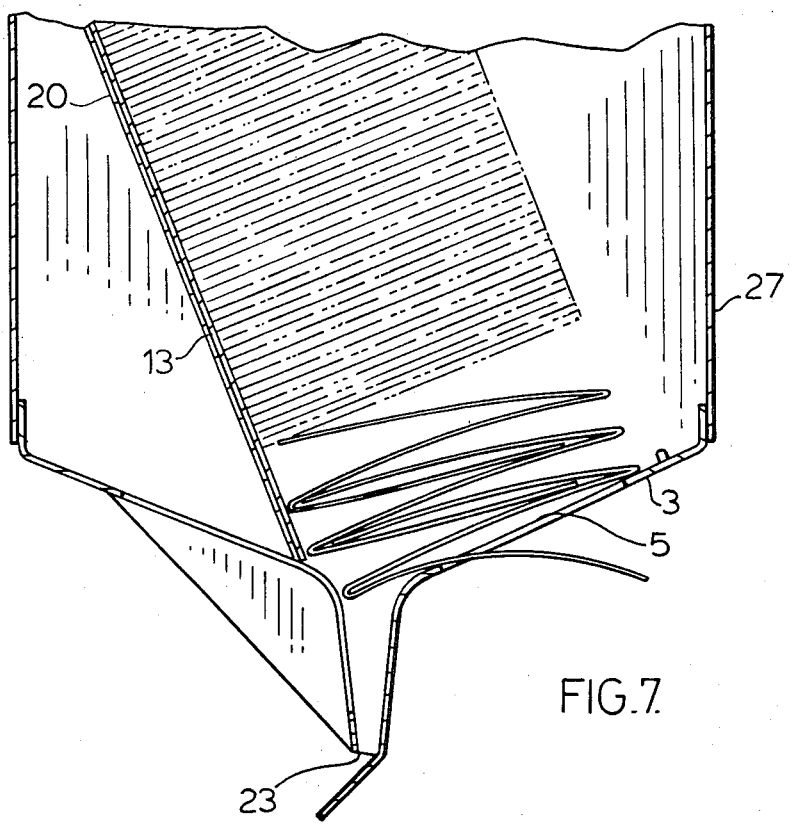

Having reference to FIGS. 5 through 7 of the drawings, the cradle is fitted with a towel guide 13 as best seen in FIG. 4 of the drawings for the dispensing of the multi-fold and C-fold towels. This towel guide comprises a hinged plate formed from plate sections 15 and 17 connected by hinge 20 and provided with openings 15*a*, 15*b* and 17*a*, 17*b* respectively. With this construction the guide plate can be collapsed to a storage position, as seen in FIG. 3 or opened up to an in-use position, as seen in FIGS. 5 through 7. When the towel guide is in the use position, it locates or guides the multi-fold and C-fold towels to the front of the cradle body directly over opening 11 in cradle surface 3. As can be seen in FIG. 5, the dispenser housing 27 is provided with a pair of hooks 29 for fitting through either one of the sets of holes 15*a*, 17*a* or 15*b*, 17*b* on the unfolded towel guide to make sure that it does not move out of its guiding position where the lower end of the towel guide extends down into the throat at right angles to support surface as seen in FIG. 5.

As will be seen in FIGS. 6 and 7 the C-fold and multi-fold towels are readily accessible directly at the front of the dispenser. Furthermore, the towel cutting bar 23 which is not used in this embodiment is located to the back of the cradle body where it is essentially hidden behind deflectors 9 so that it is not a potential hazard when reaching into the dispenser.

A very important feature of the present invention resides in the ease with which the cradle body can be removed from and reversed in the towel dispenser. More particularly, the cradle body itself is provided with an outer lip 25 at its outer ends. The dispenser housing 27 is, in turn, provided with a guide track 31 to either side of the housing for slideably receiving guide lip 25 so that the cradle body can simply be slid in and out of the housing. By closing and locking the door of the dispenser housing the cradle is then locked in either of its dispensing positions.

Figure 9:
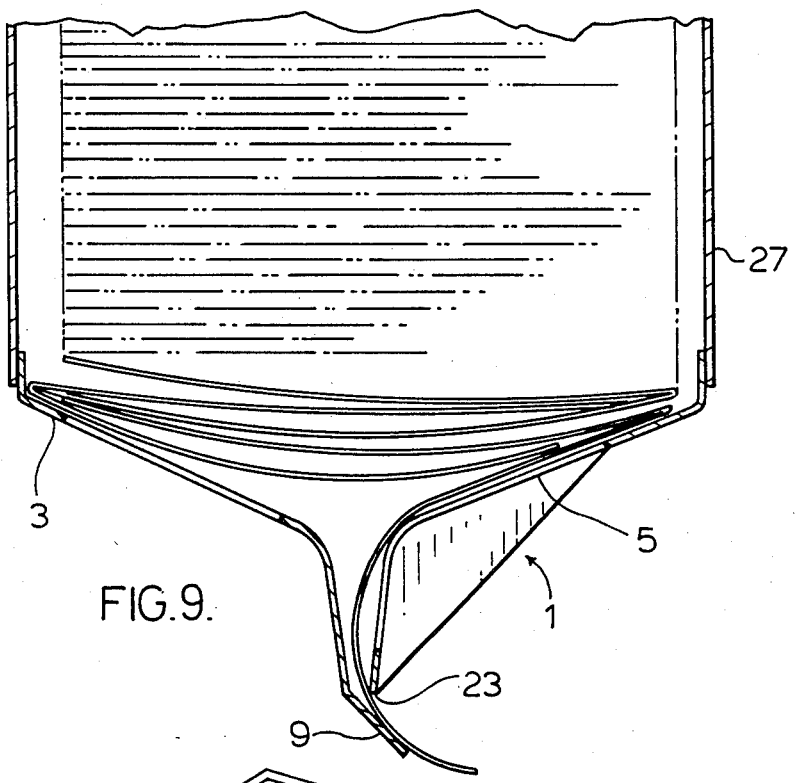
FIG. 9 is a view similar to FIG. 8 showing the dispensing of single-fold paper towels.
Figure 10:
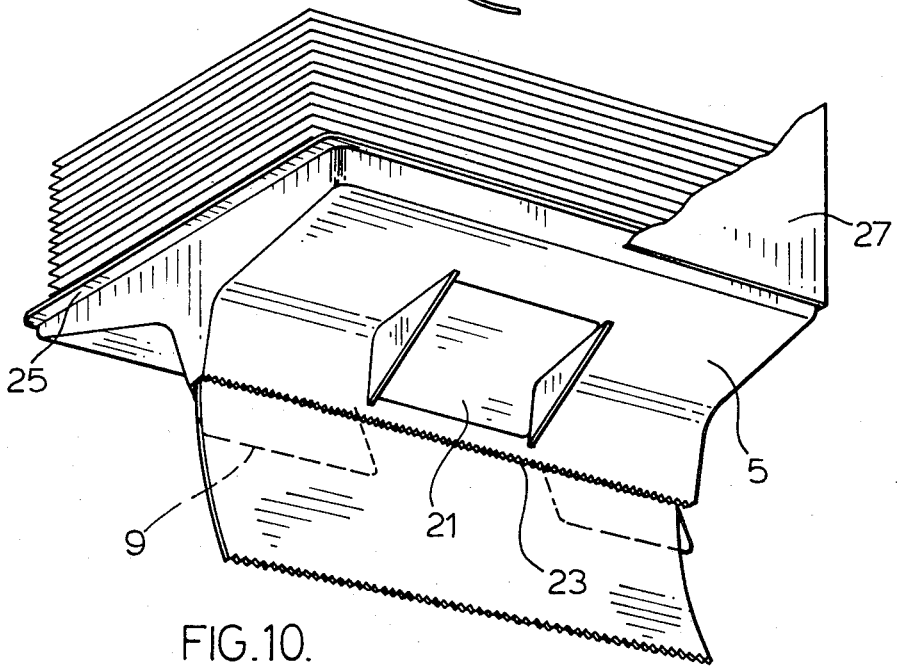
FIG. 10 is a bottom perspective view of the arrangement shown in FIGS. 8 and 9.

When the cradle body is reversed to the FIGS. 3, 9 and 10 position for use in dispensing single-fold and rolled paper towel the towel guide is not used but rather folded, turned at right angles to its in use position and is stored to the back of the cradle body. Note, in FIG. 3, that apertured surface 3 is provided with a plurality of upstanding lugs 19 onto which the folded towel guide is fitted using the two sets of holes 15*a*, 17*a*, and 15*b*, 17*b* to prevent any undesired slippage or movement of the folded towel guide.

When the cradle body is in the FIGS. 3, 9 and 10 position, the large dispensing opening 11 is located to the rear of the dispenser so that there is no temptation to draw the towels down through anything but the throat of the cradle body. The aligned finger grip accesses 4 and 21 make it extremely easy to grip on and pull the towel down through the throat. When working with rolled paper towel, cutting bar 23, which is now at the front of the cradle, is properly positioned for use in tearing the paper from the roll. In addition, the deflectors 9 extend down at an angle to guide the rolled paper and to essentially eliminate any roll back of the towel back up into the housing where it would otherwise be difficult to reach.

It will now be seen from the description above how the towel cradle of the present invention with its simple yet unique construction, including its own cutting edge and self-storing towel guide can be quickly be easily set up in the towel dispenser without requiring the use of any tools whatsoever. Furthermore, since none of the components ever leave the cradle body, they are always available for immediate use.

Although various preferred embodiments of the present invention have been described herein in detail, it will be appreciated by those skilled in the art that variations may be made without departing from the spirit of the invention or the scope of the appended claims.

The embodiments of the invention in which an exclusive property or privilege is claimed are defined as follows:

1. A paper towel dispenser comprising a housing and a hopper-like cradle within said housing, said cradle having first and second opposing support surfaces for different types of paper towel products to be dispensed from said dispenser, said housing being provided with a pair of horizontally fixed guide tracks interiorly to either side thereof and said cradle having flat outside edge runners from front to back of said cradle for sliding in and out of said guide tracks and supporting said cradle such that each of said first and second support surfaces slopes downwardly inwardly to a centrally positioned throat formed by downward extensions of said support surfaces, the downward extension of said second support surface terminating in a cutting edge and the downward extension of said first support surface terminating in a pair of spaced apart deflector members bent at an angle extending downwardly beneath said cutting edge, said first support surface having a dispensing opening therethrough and said second support surface being substantially solid, said cradle being reversible within said track from a first to a second dispensing position and when in said first dispensing position said first support surface being located to the front of said dispenser for dispensing C-fold and multi-fold paper towel through said dispensing opening with said cutting edge being generally hidden behind and blocked by said deflectors, said second support surface being located forwardly in said housing with said cradle in said second dispensing position for dispensing single-fold and rolled paper towel through said throat of said cradle, said dispenser including a towel guide usable with said cradle when in said first dispensing position and hung from said housing to guide the dispensing of the C-fold and multi-fold paper towels through said opening in said first support surface, said towel guide including a lower end located in position extending down into said throat of said cradle at substantially right angles to said first support surface of said cradle and said towel guide being hinged to fold upon itself for storing over and covering said dispensing opening in said first support surface with said cradle in said second dispensing position.

2. A paper towel dispenser as claimed in claim 1, wherein said first support surface includes upstanding lugs and said towel guide includes openings therethrough for receiving said upstanding lugs for proper location of said towel guide over said dispensing opening.

* * * * *